US007875172B2

(12) United States Patent
Giammaria

(10) Patent No.: US 7,875,172 B2
(45) Date of Patent: Jan. 25, 2011

(54) BACK-WATER TRAP FOR A FLOOR DRAIN SYSTEM

(76) Inventor: Bruno Giammaria, 1769 Prince of Wales Drive, Ottawa, Ontario (CA) K2C 1P2

( * ) Notice: Subject to any disclaimer, the term of this patent is extended or adjusted under 35 U.S.C. 154(b) by 121 days.

(21) Appl. No.: 12/385,165

(22) Filed: Mar. 31, 2009

(65) Prior Publication Data

US 2010/0243546 A1 Sep. 30, 2010

(51) Int. Cl.
*E03F 7/04* (2006.01)

(52) U.S. Cl. ..... 210/136; 210/164; 210/303

(58) Field of Classification Search ..... None
See application file for complete search history.

(56) References Cited

U.S. PATENT DOCUMENTS 414,240 A * 11/1889 Norton ..... 114/183 R
540,297 A * 6/1895 Brintnall ..... 210/165
592,690 A * 10/1897 Bragger ..... 137/216.2
947,817 A * 2/1910 Hayes ..... 210/307
1,007,463 A * 10/1911 Madden ..... 210/117
1,109,740 A * 9/1914 Dehn ..... 210/163
1,329,405 A * 2/1920 Hinton ..... 210/163
1,363,792 A * 12/1920 Johnston ..... 210/533
1,469,790 A * 10/1923 Hysko ..... 137/247.23
1,699,871 A * 1/1929 Boosey ..... 210/116
1,779,936 A * 10/1930 Hess ..... 285/263
2,246,390 A * 6/1941 Smith ..... 210/429
2,796,988 A * 6/1957 Loffler ..... 210/135
3,565,106 A * 2/1971 Baumbach et al. ..... 137/513.3
3,707,986 A * 1/1973 Breen ..... 137/849
3,973,407 A * 8/1976 Vecchio ..... 210/136
4,098,287 A * 7/1978 Baumbach ..... 137/362
4,314,583 A * 2/1982 Peterson ..... 137/533.11
4,487,219 A * 12/1984 Mäkelä et al. ..... 137/362
4,501,665 A * 2/1985 Wilhelmson ..... 210/630
4,535,800 A * 8/1985 Leech ..... 137/205
4,744,109 A * 5/1988 Yuill ..... 4/287
4,870,992 A * 10/1989 Irwin et al. ..... 137/846
5,341,523 A * 8/1994 Barnes ..... 4/507
5,582,720 A * 12/1996 Deming ..... 210/164

(Continued)

FOREIGN PATENT DOCUMENTS

CA 1 196 543 11/1985

(Continued)

*Primary Examiner*—Robert James Popovics
(74) *Attorney, Agent, or Firm*—The Nath Law Group; Jerald L. Meyer

(57) ABSTRACT

A back-water trap unit comprises a housing having an outer perimetric wall sealed to a base to define an enclosure, and a removable housing cover comprising inlet apertures. An interior wall, shorter than the housing wall, is sealed to the base to define an inner compartment and an outer compartment within the enclosure, the inner compartment being sealed by a cover secured to the upper interior wall edge and the inside of the housing wall. A flapper valve secured to the interior wall within the inner compartment is rotatable in response to liquid pressure to open or close an inlet aperture proximate the lower interior wall edge. An outlet through the housing wall as high as or above the upper edge of the inlet aperture allows discharge of fluid from the inner compartment, while the flapper valve prevents unwanted back-flow from the inner compartment to the outer compartment.

16 Claims, 4 Drawing Sheets

U.S. PATENT DOCUMENTS

| | | | | |
|---|---|---|---|---|
| 5,728,294 | A * | 3/1998 | Deming | 210/164 |
| 5,915,408 | A * | 6/1999 | Dudley | 137/244 |
| 5,976,364 | A * | 11/1999 | Williams | 210/136 |
| 6,318,397 | B1 * | 11/2001 | Huber et al. | 137/15.19 |
| 6,558,077 | B1 * | 5/2003 | Colson | 405/36 |
| 6,719,489 | B1 * | 4/2004 | Colson | 405/36 |
| 6,795,987 | B2 * | 9/2004 | Cornwall | 4/679 |
| 7,662,280 | B1 * | 2/2010 | Cooney | 210/164 |
| 2004/0049846 | A1 * | 3/2004 | Cornwall | 4/679 |

FOREIGN PATENT DOCUMENTS

| | | |
|---|---|---|
| CA | 1 272 659 | 8/1990 |
| CA | 2 429 950 | 3/2004 |

* cited by examiner

BACK-WATER TRAP FOR A FLOOR DRAIN SYSTEM

FIELD OF THE INVENTION

The present invention relates to floor drains for buildings. More particularly, the present invention relates to back-water traps for floor drains, which are installed in buildings, that allow any water flowing into a basement, subfloor or weeping tiles of the building to flow into the sewer while preventing the back-up of sewer water or sewer gases through the floor drain and into the building.

BACKGROUND OF THE INVENTION

In general, the design of floor drains has not drastically changed over the years. Floor drains are typically installed into basements, subfloors or weeping tiles of buildings to allow any water flowing into the same to flow into a sewer line. Most conventional floor drains contain what is known as a "p-style" trap. A serious problem with these conventional floor drains is that while the p-style trap allows water to drain from the basement, subfloor or weeping tile, the p-style trap can allow sewer water from the sewer line to back up into the building due to rising water levels from various causes, including overflow from excess water, or due to debris clogging the sewer line. This type of trap generally allows for some water to remain in the adjacent drain pipe, but if the water in a conventional floor drain system containing a p-style trap completely evaporates or drains, sewer gases from the sewer system can escape into the building through the floor drain, which can be very harmful to occupants of the building.

Various solutions have been suggested for attempting to overcome these problems of conventional floor drain systems.

For example, Canadian Patent 2,429,950 (U.S. Pat. No. 6,795,987) discloses a floor drain system in which the device is intended to stop the backflow of water and of sewer gases, by providing a valve having a flexible outlet, which is intended to open from a curled closed position to an uncurled open position in response to water entering from the inlet above. However, the valve outlet is located within a single compartment, such that in the event that a large volume of liquid backed up into the single compartment from the external sewer system when the valve was already in the uncurled open position within the liquid, the flexible outlet would be impeded by the high pressure of the water from returning to a curled closed position, to prevent liquid flow upwards through the drain. Further, any solid matter can readily become lodged in the flexible outlet and impede it from curling to return to its intended closed position.

Canadian Patent 1,196,543 (U.S. Pat. No. 4,487,219) discloses a floor drain device which is intended to prevent fluid backing up into a building, by providing a cupped sealing device intended to prevent sewer liquids and associated bacteria from passing through the drain into the building. The device attempts to prevent the height of liquid in its single compartment from exceeding the height of the upper level of the outlet pipe, so as to provide an air gap between the liquid in the compartment and the narrowed inlet aperture from the upper opening of the unit. However, in the event of a substantial, particularly if sudden, backflow into the unit through the outlet from the sewer system, the air gap could be eliminated so that liquid could flow upwards into the building; or could force the unit itself upwards through the drain opening. Further, if the unit goes dry, the device has no means of preventing gases passing up through the drain into the building.

Canadian Patent 1,272,659 (U.S. Pat. No. 4,744,109) discloses a device which is intended to prevent radon gas leakage into a building, but does not include any means of preventing the backflow of water through the floor drain and into the building.

It has been found that an improved trap can be provided for a floor drain system which prevents the backflow of sewer water and sewer gases from the sewer line into the building, thereby avoiding the problems of excess water entering through the drain into the basement, and the consequent costs of repairs for damage from the backflow of water through the sewer line, and the environmental risks, including injury from gas or bacteria, and discomfort from consequent odors, to occupants of the building.

SUMMARY OF THE INVENTION

The present invention provides a simple economical back-water trap unit which can readily be installed in the floor drain of a building, to allow any liquid flowing into a basement, subfloor or weeping tiles of the building to flow into the sewer in the conventional manner while preventing the back-up of sewer liquid or sewer gases through the floor drain and into the building.

The back water trap of the present invention prevents floods in basements due to liquid or sewage backing up from the sewer system, and prevents foundation water from accumulating on or under the concrete floor.

In a first broad aspect, the present invention seeks to provide back-water trap unit for a floor drain of a building comprising (i) a housing having (a) a base with an upper surface; (b) an outer perimetric housing wall having an inner surface, an outer surface, and upper and lower wall edges and being sealingly connected at the lower wall edge to the upper surface of the base to define an enclosure; and (c) a housing cover removably securable to the upper wall edge and comprising a plurality of inlet apertures;

(ii) an interior wall having (a) an upper interior wall edge; (b) a lower interior wall edge sealingly connected to the upper surface of the base to define an inner compartment and an outer compartment within the enclosure, the interior wall having a height less than a height of the housing wall; (c) an inner compartment cover sealingly connected to the upper interior wall edge and to the inner surface of the housing wall; (d) an inlet aperture proximate the lower interior wall edge and having an upper edge; and (e) a flapper valve pivotally secured to the interior wall within the inner compartment, constructed and arranged to rotate between an inlet open position and an inlet closed position in response to liquid pressure from the enclosure; and (iii) an outlet through the housing wall constructed and arranged to provide a fluid discharge conduit from the inner compartment, and located at a vertical height at least equal to the vertical height of the upper edge of the inlet aperture above the upper surface of the base.

Preferably, the inner compartment of the back-water trap unit has a volume which is less than a volume of the outer compartment.

Preferably, the inner compartment cover of the back-water trap unit comprises a plurality of fastener locations; and the upper interior wall edge comprises a fastener receiving surface constructed and arranged to releasably secure the inner compartment cover using a plurality of fasteners at the fastener locations.

Preferably, the housing wall comprises a perimetric radially projecting rim; and the housing cover comprises an edge constructed and arranged to be releasably secured inside the rim in an interference fit.

Optionally, the back-water trap unit comprises a weeping tile fluid intake means opening into the outer compartment through the outer perimetric wall.

Optionally, the back-water trap unit comprises a fresh water intake means opening into the outer compartment through the outer perimetric wall.

The two-compartment construction of the back-water trap unit of the present invention thus ensures that any residual water in the drain downstream from the flapper valve holds that valve closed, thus preventing backflow of fluids between the two sections. Further, by reason of the locational relationship of the outlet from the inner compartment to the sewer system and the flapper valve between the two compartments, the flapper valve will remain closed even if the outer compartment becomes dry, so that regardless of the wet or dry condition the outer compartment, the flapper valve will prevent sewer water and/or gases from backing up into the building.

The back-water trap unit can have various different constructions and configurations, but preferably has a substantially cylindrical configuration, which allows for simple and effective installation into basement floors or any other area that requires a floor drain, and in particular to existing conventional drain openings.

BRIEF DESCRIPTION OF THE DRAWINGS

The present invention will now be described in relation to the drawings, in which.

DETAILED DESCRIPTION OF THE DRAWINGS

In the description below, the invention is discussed in relation to all forms of liquid. Although liquid flowing through the drain opening into the back-water trap unit will generally be water, the unit is suitable for controlling the drainage and preventing backflow of all manner of liquids, and in particular for preventing backflow of any liquid from the sewer system to which the unit is connected.

Figure 1:
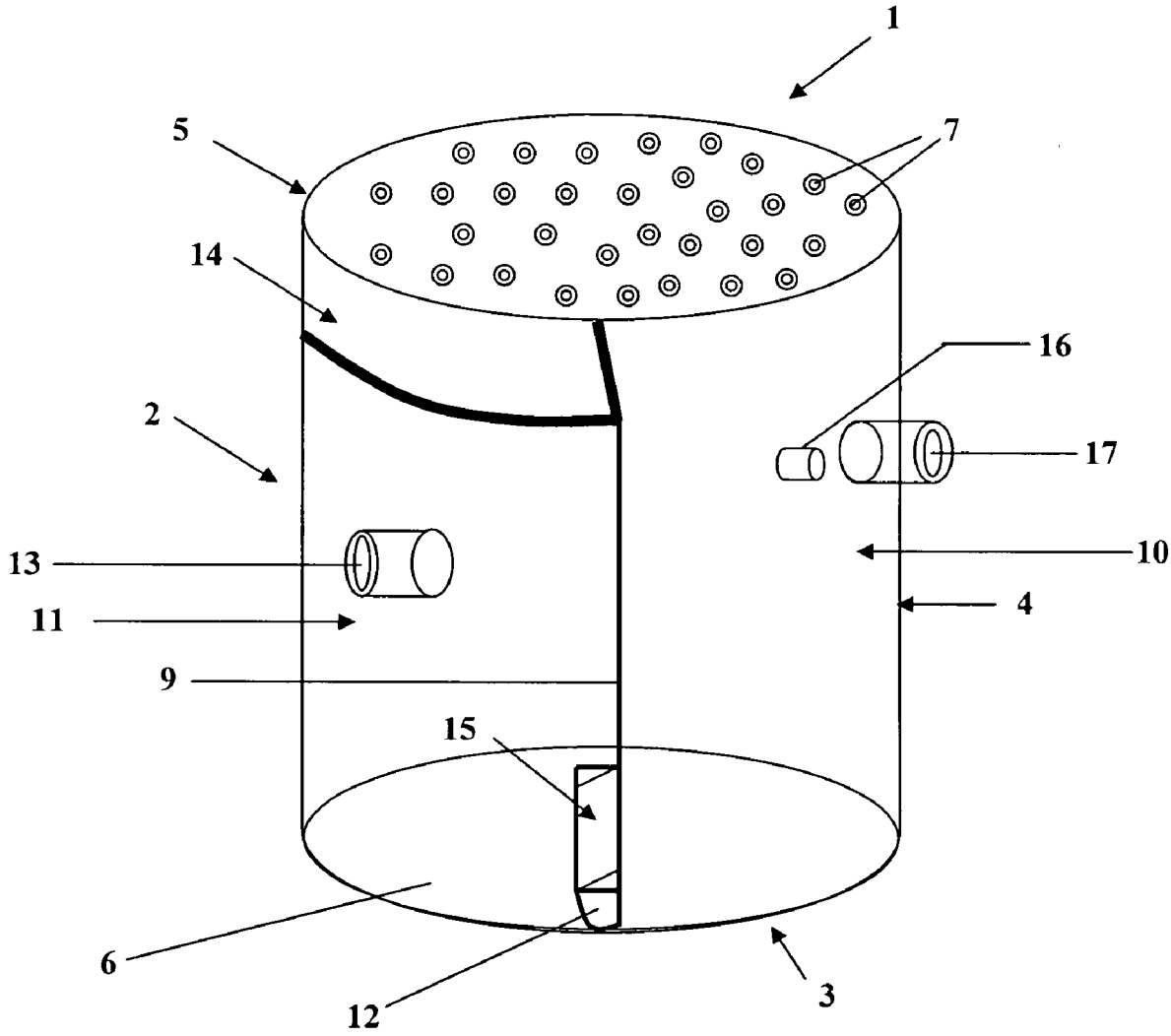
FIG. 1 is a perspective schematic view of the back-water trap unit of the present invention.
Figure 2:
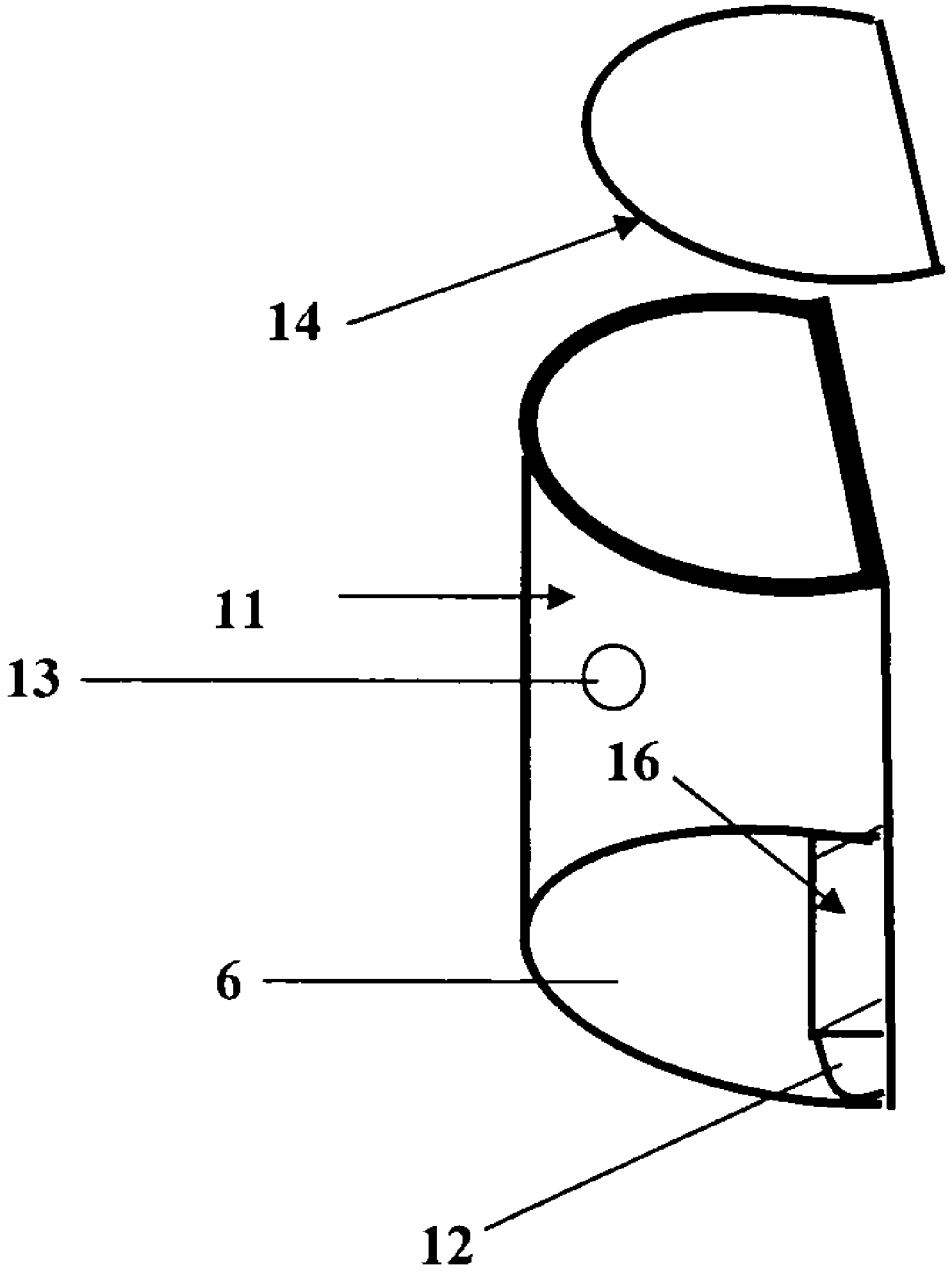
FIG. 2 is a perspective schematic view of the sealed section of the back-water trap unit of the present invention.
Figure 4:
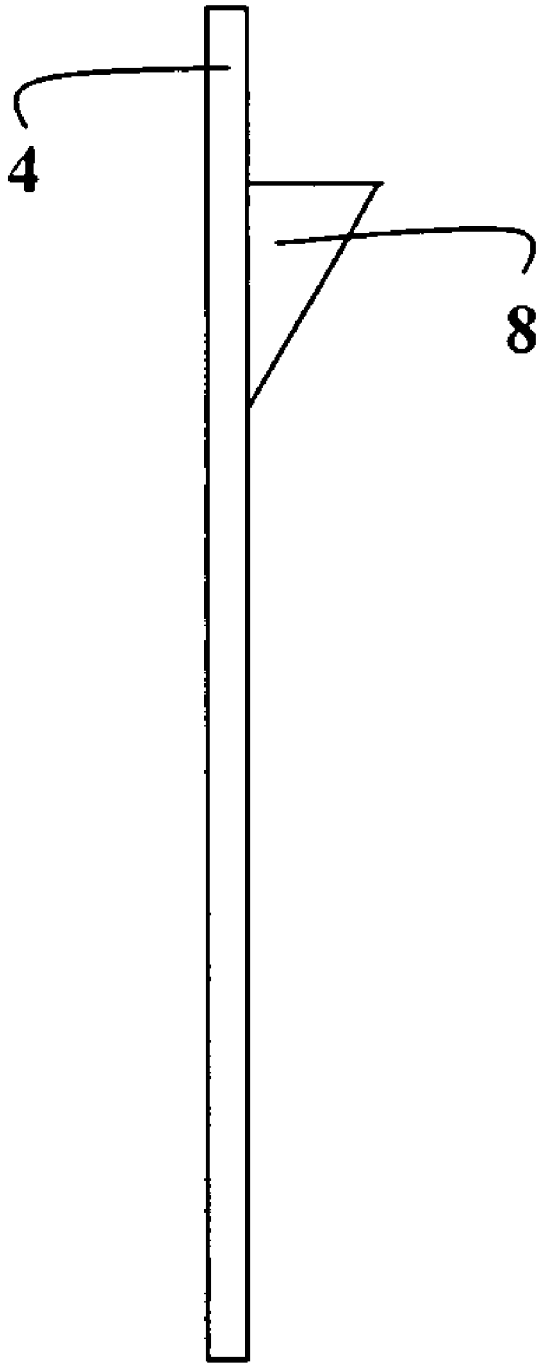
FIG. 4 is a sectional side view of the housing wall at the inner compartment of the unit.

Referring now to FIGS. 1 and 2, a back-water trap unit 1 according to the present invention is shown. The back-water trap unit 1 includes a housing 2 which comprises a base 3, an outer perimetric housing wall 4 and a housing cover 5. The outer perimetric housing wall 4 is sealingly connected at its lower edge to an upper surface 6 of the base 3 so as to define an enclosure. The housing cover 5 is removably securable by any suitable means to an upper wall edge of the outer perimetric housing wall 4 and contains a plurality of apertures 7 to allow liquid to flow from a floor of a building into the back-water trap unit 1. In one embodiment of the invention, the outer perimetric housing wall 4 comprises a perimetric radially projecting rim 8 (shown in FIG. 4) and the housing cover 5 comprises an edge correspondingly configured to allow the housing cover 5 to be releasably secured inside the rim 8 in an interference fit.

Inside the housing 2 is an interior wall 9 that is sealingly connected to the same upper surface 6 of the base 3 as the outer perimetric wall 4. The interior wall 9 divides the enclosure into two compartments, an outer compartment 10 into which liquid flows from the floor of a building through the apertures 7, and an inner compartment 11. An inlet aperture 12 is provided in the interior wall 9 proximate the lower edge of the interior wall 6. Liquid within the inner compartment 11 is released into a sewer system via an outlet 13 located on the outer perimetric wall 4 and directly connected to the inner compartment 11. For more efficient drainage of liquid from the building into the back-water trap unit 1, preferably the volume of the inner compartment 11 is less than the volume of the outer compartment 10. The outlet 13 is located at an installed vertical height which is at least equal to, and preferably substantially greater than, the vertical height of the upper edge of the inlet aperture 12 above the upper surface 6 of the base 3.

Figure 3:
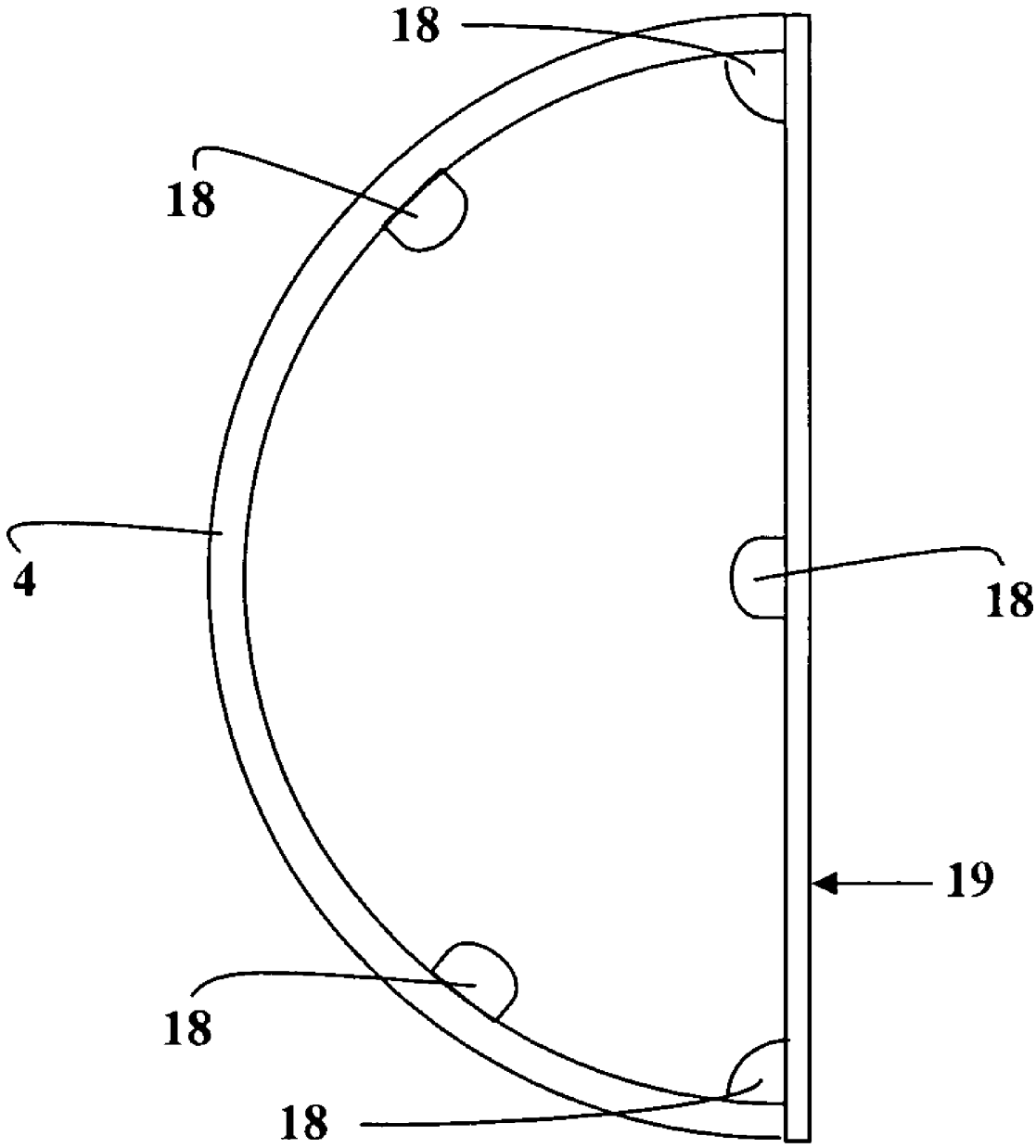
FIG. 3 is a top view of the inner compartment of the unit.

Referring also to FIG. 3, the inner compartment 11 is sealed with an inner compartment cover 14 which is connected to an upper edge of the interior wall 9 and to an inner surface of the housing wall 4 to provide a sealed compartment 11. The inner compartment cover 14 can be connected by any suitable means, but preferably a plurality of protrusions 18 are provided at the upper edge of the inner wall 9 and correspondingly at the opposing portion of the inner surface of the housing wall 4, and fastening means such as screws (not shown) are provided around the perimeter of the cover 14 to secure it to the protrusions 18, to seal the inner compartment 11. Alternatively, the opposing portion of the inner surface of the housing wall 4 can be provided with a partial ridge instead of one or more of the protrusions 18, to create an even more reliable seal for the inner compartment 11. Preferably a gasket 19 (shown in FIG. 3) is provided to facilitate the sealing of the inner compartment 11. The fastening means can be removed to allow for temporary removal of the inner compartment cover 14 to facilitate cleaning or maintenance.

The outer compartment 10 is preferably unsealed but is covered, as described above, by housing cover 5.

A flapper valve 15 is pivotally secured to the interior wall 9 at the inlet aperture 12 within the inner compartment 11 and is constructed to be rotatable into the inner compartment 11 between an inlet open position and an inlet closed position in response to liquid pressure.

Once installed into a drain opening, the back-water trap unit 1 operates in the following manner. Any liquid flowing into the drainage opening of a basement of the building flows through the housing cover 5 to be collected in the outer compartment 10. As the liquid level in the outer compartment 10 rises, it forces the flapper valve 15 to rotate into an open position to allow liquid to flow into the sealed inner compartment 11. As the liquid level rises within the inner compartment 11, the liquid is discharged from the inner compartment 11 through the outlet 13 into conventional collection pipes (not shown) leading to the main sewer (not shown).

After flow into the outer compartment 10 ceases, the liquid level in the two compartments 10 and 11 equalizes, and the flapper valve 15 rotates back to its closed position in response to pressure. Thereafter, the remaining liquid in the sealed inner compartment 11 is prevented from flowing back into the outer compartment 10.

As the flapper valve 15 remains closed, there can be no flow of sewer gases from the main sewer system into and through the outer compartment 10 of the back-water trap unit 1, and thus through the drain opening into the building.

However, optionally, the outer perimetric wall 4 can also include a fresh water inlet 16 which opens into the outer compartment 10, and which can be connected to a fresh water source from which water can be supplied to the outer compartment 10 to ensure that the back-water trap unit 1 always contains a minimal amount of water.

In a further embodiment of the invention, the outer perimetric wall 4 can also include a weeping tile fluid/subfloor inlet 17 opening into the outer compartment 10, which can be connected to a conduit connected directly into a weeping tile system or subfloor (not shown). In this embodiment, the liquid flows directly into the outer compartment 10, and not through the housing cover 5.

I claim:

1. A back-water trap unit comprising:

(i) a housing having (a) a base with an upper surface;

(b) an outer perimetric housing wall having an inner surface, an outer surface, and upper and lower wall edges and being sealingly connected at the lower wall edge to the upper surface of the base to define an enclosure; and (c) a housing cover removably securable to the upper wall edge and comprising a plurality of inlet apertures;

(ii) an interior wall having (a) an upper interior wall edge;

(b) a lower interior wall edge sealingly connected to the upper surface of the base to define an inner compartment and an outer compartment within the enclosure, the interior wall having a height less than a height of the housing wall;

(c) an inner compartment cover sealingly connected to the upper interior wall edge and to the inner surface of the housing wall;

(d) an inlet aperture proximate the lower interior wall edge and having an upper edge; and (e) a flapper valve pivotally secured to the interior wall within the inner compartment, constructed and arranged to rotate between an inlet open position and an inlet closed position in response to liquid pressure from the enclosure; and (iii) an outlet through the housing wall constructed and arranged to provide a fluid discharge conduit from the inner compartment, and located at a vertical height at least equal to the vertical height of the upper edge of the inlet aperture above the upper surface of the base.

2. A back-water trap unit according to claim 1, further comprising a weeping tile fluid intake means opening into the outer compartment through the outer perimetric wall.

3. A back-water trap unit according to claim 2, further comprising a fresh water intake means opening into the outer compartment through the outer perimetric wall.

4. A back-water trap unit according to claim 2, wherein the inner compartment has a volume which is less than a volume of the outer compartment.

5. A back-water trap unit according to claim 2, wherein the inner compartment cover comprises a plurality of fastener locations; and the upper interior wall edge comprises a fastener receiving surface constructed and arranged to releasably secure the inner compartment cover using a plurality of fasteners at the fastener locations.

6. A back-water trap unit according to claim 2, wherein the housing wall comprises a perimetric radially projecting rim; and the housing cover comprises an edge constructed and arranged to be releasably secured inside the rim in an interference fit.

7. A back-water trap unit according to claim 1, further comprising a fresh water intake means opening into the outer compartment through the outer perimetric wall.

8. A back-water trap unit according to claim 7, wherein the inner compartment has a volume which is less than a volume of the outer compartment.

9. A back-water trap unit according to claim 7, wherein the inner compartment cover comprises a plurality of fastener locations; and the upper interior wall edge comprises a fastener receiving surface constructed and arranged to releasably secure the inner compartment cover using a plurality of fasteners at the fastener locations.

10. A back-water trap unit according to claim 7, wherein the housing wall comprises a perimetric radially projecting rim; and the housing cover comprises an edge constructed and arranged to be releasably secured inside the rim in an interference fit.

11. A back-water trap unit according to claim 1, wherein the inner compartment has a volume which is less than a volume of the outer compartment.

12. A back-water trap unit according to claim 11, wherein the inner compartment cover comprises a plurality of fastener locations; and the upper interior wall edge comprises a fastener receiving surface constructed and arranged to releasably secure the inner compartment cover using a plurality of fasteners at the fastener locations.

13. A back-water trap unit according to claim 11, wherein the housing wall comprises a perimetric radially projecting rim; and the housing cover comprises an edge constructed and arranged to be releasably secured inside the rim in an interference fit.

14. A back-water trap unit according to claim 1, wherein the inner compartment cover comprises a plurality of fastener locations; and the upper interior wall edge comprises a fastener receiving surface constructed and arranged to releasably secure the inner compartment cover using a plurality of fasteners at the fastener locations.

15. A back-water trap unit according to claim 14, wherein the housing wall comprises a perimetric radially projecting rim; and the housing cover comprises an edge constructed and arranged to be releasably secured inside the rim in an interference fit.

16. A back-water trap unit according to claim 1, wherein the housing wall comprises a perimetric radially projecting rim; and the housing cover comprises an edge constructed and arranged to be releasably secured inside the rim in an interference fit.

* * * * *